US006612135B1

(12) United States Patent
Pinzauti

(10) Patent No.: US 6,612,135 B1
(45) Date of Patent: Sep. 2, 2003

(54) PROCESS FOR KNITTING A WEFT-KNITTED FABRIC SO THAT CUT PILE IS FORMED ON THE BACKSIDE STITCHES, A KNITTING MACHINE OPERATING ACCORDING TO THE PROCESS AND A KNITTED FABRIC OBTAINABLE WITH SUCH PROCESS AND MACHINE

(75) Inventor: Piero Pinzauti, Montale (IT)

(73) Assignees: Pinzauti Lucia, Montale (IT); Pinzauti Adriano, Montale (IT)

( * ) Notice: Subject to any disclaimer, the term of this patent is extended or adjusted under 35 U.S.C. 154(b) by 0 days.

(21) Appl. No.: 10/070,993

(22) PCT Filed: Sep. 8, 2000

(86) PCT No.: PCT/IT00/00356

§ 371 (c)(1),
(2), (4) Date: Mar. 14, 2002

(87) PCT Pub. No.: WO01/20067

PCT Pub. Date: Mar. 22, 2001

(30) Foreign Application Priority Data

Sep. 14, 1999 (IT) ..... FI99A0190

(51) Int. Cl.[7] ..... D04B 35/02
(52) U.S. Cl. ..... 66/93
(58) Field of Search ..... 66/91, 92, 93, 66/8, 90

(56) References Cited

U.S. PATENT DOCUMENTS

| | | | | |
|---|---|---|---|---|
| 3,845,641 A | | 11/1974 | Waller | |
| 4,537,048 A | * | 8/1985 | Gutschmit et al. | 66/93 |
| 4,592,212 A | * | 6/1986 | Schmidt | 66/91 |
| 4,900,605 A | | 2/1990 | Thorgersen et al. | |

* cited by examiner

*Primary Examiner*—Danny Worrell
(74) *Attorney, Agent, or Firm*—Browdy and Neimark, P.L.L.C.

(57) ABSTRACT

In a process for knitting a weft-knitted fabric (T) by means of mutually opposite needlebeds comprising axially slidable needles, the needles being operated in correspondence to a yarn feed, said yarn consisting in a base thread ($F_F$) and a pile thread ($F_p$) mutually coupled, for stitches in correspondence with which pile has to be formed, when the needle is engaging the yarn, the pile thread ($F_p$) is separated from said base thread ($F_F$) and retained so that a bridle (B) is formed on the backside between the new stitch and the previous stitch of the same rank (R), while the base thread ($F_F$) forms a normal backside stitch lower loop. The bridle (B) is subsequently cut in order to obtain the cut pile, as the fabric under formation progressively moves down. The invention also relates to a knitting machine specifically designed and built for carrying out the process and to a knitted fabric obtainable with such process and machine.

22 Claims, 2 Drawing Sheets

PROCESS FOR KNITTING A WEFT-KNITTED FABRIC SO THAT CUT PILE IS FORMED ON THE BACKSIDE STITCHES, A KNITTING MACHINE OPERATING ACCORDING TO THE PROCESS AND A KNITTED FABRIC OBTAINABLE WITH SUCH PROCESS AND MACHINE

FIELD OF THE INVENTION

The present invention relates to the field of knitted fabrics, and namely it concerns a new knitting process for obtaining a so-called "pile" fabric. The invention also relates to a knitting machine aimed at operating according to the process, and a knitted fabric obtainable with such process and machine.

BACKGROUND ART

Presently, the textile industry offers a wide range of so-called "pile" fabrics, i. e. fabrics providing on one side a distribution of tufts or hairs, formed by way of a effect (or pile) yarn. The processes for manufacturing such fabrics, and consequently the machines aimed at carrying out them, are likewise various. Considering in particular the cut pile knitted fabrics obtained by means of flat or circular knitting machines—disregarding ecological furs and peluche fabrics—according to the prior art, loops are formed, like in the terry fabrics, and cut during the finishing steps, through the so-called "shearing" operation.

With this process it is not possible to obtain pile fancy patterns, because the terry fabric knitting machines do not allow to freely arrange the pile loops, as a function of the pattern one wishes to obtain on a side of the fabric.

Besides, the shearing operation involves up to 30% yarn wastes (pile loops are cut about half their length), thus causing a remarkable increase in the production costs, which are in any case burdened by the additional shearing productive step.

SUMMARY OF THE INVENTION

The main object of the present invention is to allow the manufacturing of a weft-knitted fabric so that cut pile is formed in the course of the knitting productive step.

While accomplishing the above mentioned general object, a particular object of the present invention is to permit a free arrangement of the cut pile among the normal stitches of the fabric, in order to obtain pile fancy designs and/or patterns.

Said objects are attained with the weft-knitting process having the essential features defined in appended claim 1.

An improved knitting machine operating according to the process is essentially as defined by appended claim 10.

A knitted fabric obtainable with such process and machine has the features essentially defined by appended claim 20.

BRIEF DESCRIPTION OF THE DRAWINGS

For a fuller appreciation of the features and advantages afforded by the process for knitting a weft-knitted fabric so that cut pile is formed on the backside stitches, the knitting machine operating according to the process and the knitted fabric obtainable with such process and machine according to the present invention, a preferred embodiment thereof will now be described by way purely of example and implying no limitation, with reference to the accompanying drawings, in which.

DESCRIPTION OF THE PREFERRED EMBODIMENT

Figure 1:
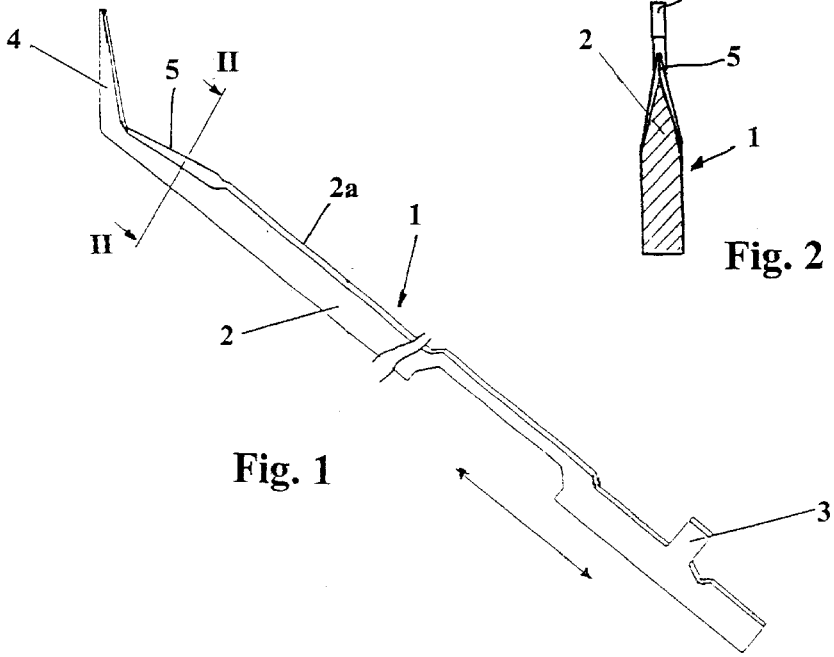
FIG. 1 shows a perspective view of a slidable member for use in the process according to the invention.
Figure 2:
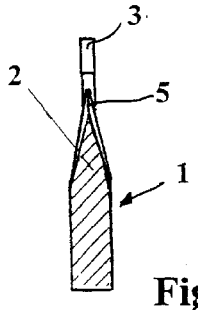
FIG. 2 shows a cross section view taken along line II—II of FIG. 1.

With reference to FIGS. 1 and 2, according to a preferred embodiment of the invention, a slidable member 1 is used, having an elongated shape comprising a shank 2 which is provided with an end butt 3 for allowing a reciprocating operation, according to the system commonly used for operating knitting needles. Butt 3 extends in a orthogonal direction from an edge 2*a* of shank 2, such edge being that which, in use, is placed upwards, as will be explained hereinafter.

The other end of slidable member 1, i. e. the working end thereof—also in this case, as will be made clearer hereinafter—has a pointed foot 4, which extends from upper edge 2*a* of shank 2, accomplishing a substantially L-shaped arrangement. A cutting rim portion 5 is formed by upper edge 2*a* of shank 2, close to foot 4. In the depicted example cutting rim 5 slightly slopes towards foot 4.

Figure 3:
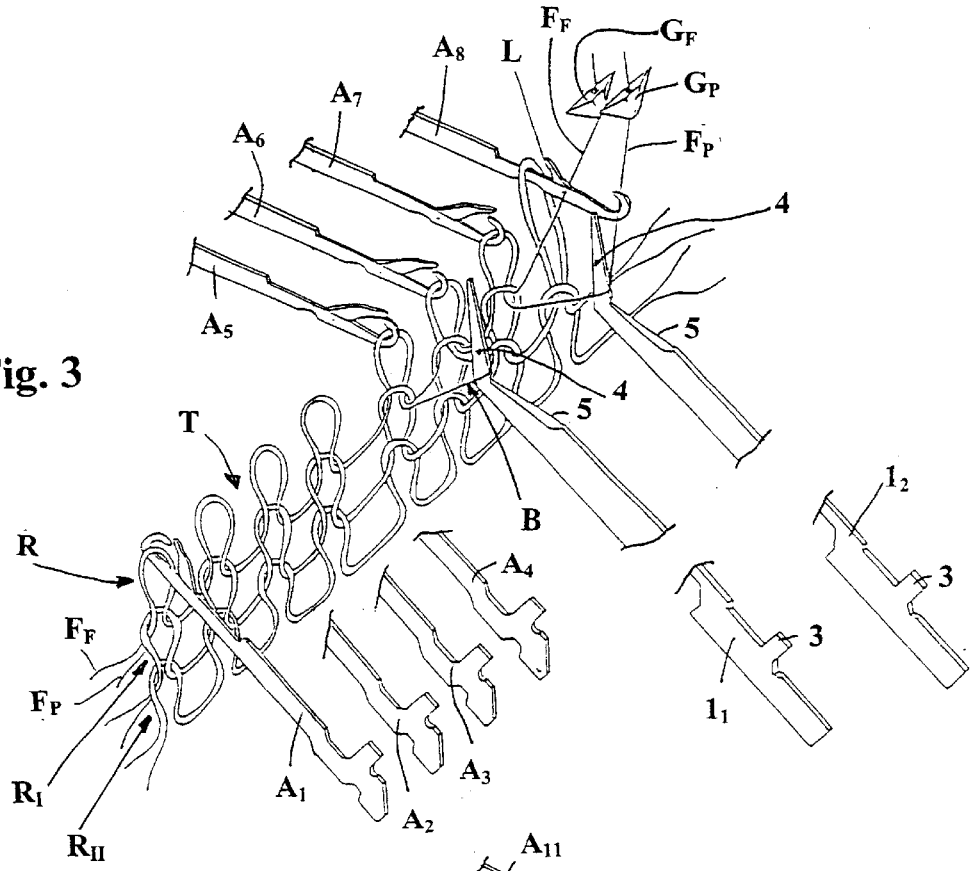

With reference now to FIG. 3, in a flat knitting machine, neither shown nor described as a whole since for all that is not explicitly mentioned its features are according to the prior art, two opposite knitting needlebeds cooperate in order to form a knitted fabric T. In greater detail, consecutive ranks of stitches R, $R_I$, $R_{II}$, of fabric T are visible, the latest of said ranks—that is to say rank R which is being formed in the represented step—has the relevant stitch loops engaged by the knitting needles.

Namely, needles $A_1$, $A_2$, $A_3$ and $A_4$—needles $A_2$ to $A_4$ being illustrated only partially, for the sake of clarity—are loaded with the loops of newly formed rightside stitches, while needles $A_5$, $A_6$ and $A_7$ of the opposite needlebed are loaded with backside stitch loops. A following needle $A_8$ of this same needlebed is forming the pertinent stitch of rank R, as described in detail later on. Besides, it has to be noticed that the weft of fabric T is formed by a base yarn thread $F_F$ and a effect or pile yarn thread $F_p$, mutually coupled. Running along threads $F_F$ and $F_p$, a rightside stitch portion formed by needles from $A_1$ to $A_4$ is followed by a backside stitch portion formed by needles from $A_5$ to $A_7$. The threads are fed by feeders $G_F$, for base thread $F_F$, and $G_P$, for pile thread $F_p$.

According to the preferred embodiment of the invention, slidable members 1 operatively replace respective needles of the needlebed which is opposite to that creating the base of the pertinent stitches, in order to form cut pile in correspondence thereof. For instance, FIG. 3 shows two slidable members $\mathbf{1}_1$ and $\mathbf{1}_2$, slidably housed in the grooves which, in a conventional machine, respectively between needles $A_5$ and $A_6$ and between needles $A_7$ and $A_8$ of a needlebed, support needles of the needlebed opposite thereto. The cut pile is formed according to the following working steps, described as far as needle As is concerned and referring also to FIG. 4.

Needle $A_8$, loaded with a stitch of rank $R_I$ (previous to rank R which is being formed), is operated by the machine cam system and moves forward, so that the old stitch opens the corresponding lever, indicated at L, and locates under the same. Then, needle $A_8$ starts moving backward and feeders $G_F$ and $G_p$ bring the respective threads $F_F$ and $F_p$ in front of the needle hook, allowing the latter to engage with them.

Figure 4:
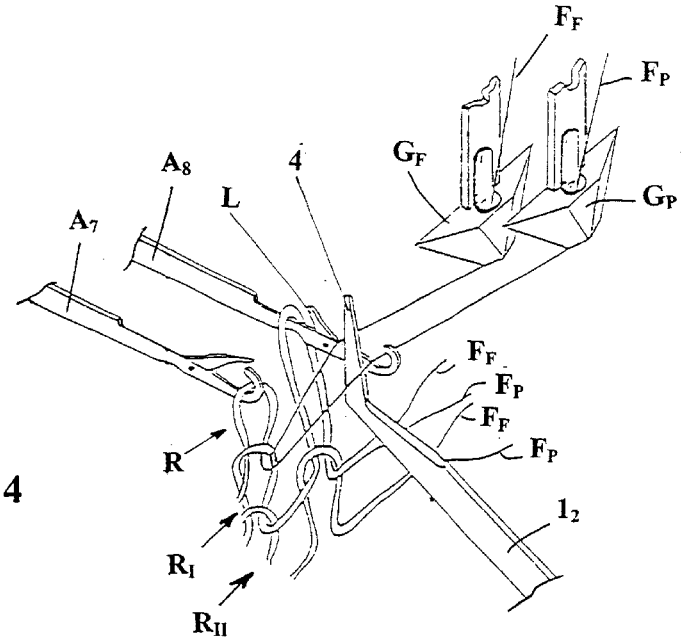
FIGS. 3, 4 and 5 show partial and schematic perspective views of the opposite needlebeds of a flat knitting machine operating according to the invention, in respective successive steps of the pile-forming knitting process.

In the meantime, sliding member $\mathbf{1}_2$ —placed between needle As and the previous one $A_7$ —has moved forward, locating the tip of its foot 4 in correspondence to the theoretical intersection axis between the planes of the two needlebeds. In this condition, as the feeders $G_F$ e $G_p$ pass, foot 4, of which the tip is slightly higher than the needle hooks, inserts between the base thread $F_F$ and the pile thread $F_p$, so as to keep them separate. FIGS. 3 and 4 actually represent such phase, in two steps immediately following one another, and it is clearly noticeable how foot 4 retains pile thread $F_p$ as this is hooked by needle $A_8$.

When needle $A_8$ stops its backward motion, the old stitch of rank $R_I$ has been unloaded, after closing lever L, and a new stitch of rank R has been formed. However, foot 4 of sliding member $\mathbf{1}_2$ has formed a bridle B between the beginning of the upper loop of said new stitch and the end of the previous stitch of the same rank R, i. e. the stitch that is engaged by needle $A_7$. This condition is shown more clearly in FIG. 3, in respect of needles As and $A_6$ and the corresponding sliding member $\mathbf{1}_1$. The latter, by retaining pile thread $F_p$, has thereby formed a bridle B, while base thread $F_F$ has conventionally formed a normal lower loop.

Figure 5:
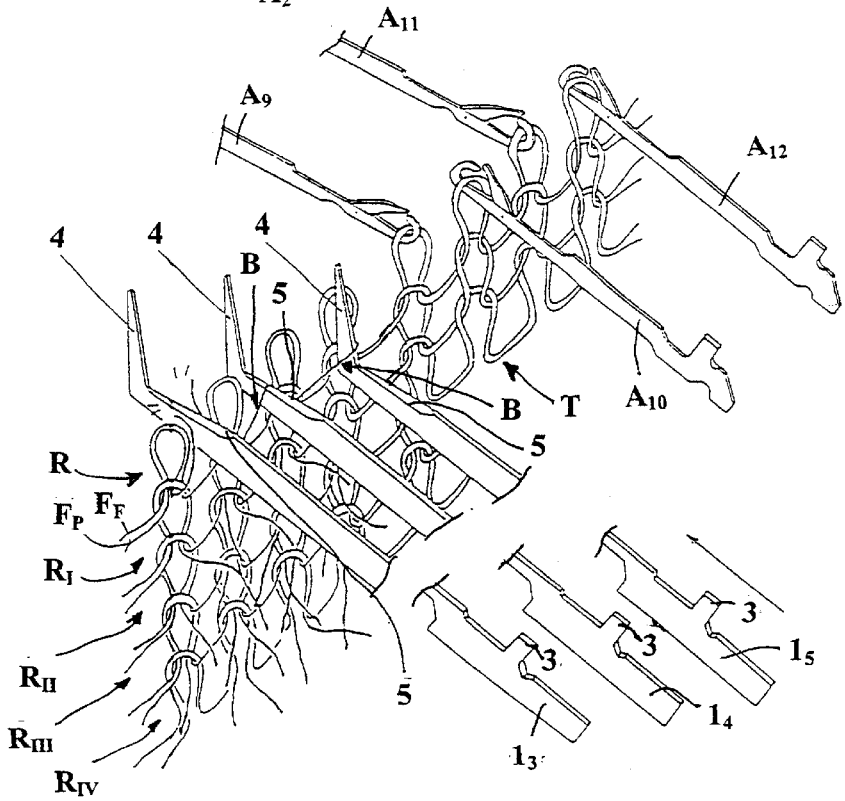

The release of fabric T from the engagement with feet 4 of sliding members 1, necessary in order to allow the drop of the fabric itself operated by the takedown system of the machine, is accomplished as bridle B is cut by cutting rim portion 5 of the sliding member, thus forming the cut pile. Such stage is shown in FIG. 5, in which three adjacent sliding members $\mathbf{1}_5$, $\mathbf{1}_4$ and $\mathbf{1}_3$ are represented in three successive working steps. Starting from the position retaining bridle B formed by thread $F_p$ (sliding member $\mathbf{1}_5$) , the member forward movement according to the arrow causes bridle B to drop over cutting portion 5 (member $\mathbf{1}_4$) and then the cutting off of thread $F_p$, consequently forming the cut pile (member $\mathbf{1}_3$). The cutting off of thread $F_p$ is made easier by the fact that bridle B is stretched over cutting portion 5, such condition being assisted by the slight slope thereof towards foot 4.

The result which is accomplished can be clearly seen in the same FIG. 5, wherein cut pile formations are represented also in previously knitted ranks $R_I$, $R_{II}$, $R_{III}$ and $R_{IV}$, in correspondence to the stitches involved by the operation of sliding members 1. In this respect, it has to be noticed that the length of the pile formed can be easily adjusted by suitably controlling the operation of sliding member 1. In fact, a backward displacement of the latter during the stage in which bridle B is engaged by foot 4—that is to say the stage shown in FIGS. 3 and 4—pulls more thread $F_p$ from the corresponding feeder $G_p$, thus causing the bridle B to become longer. In other words, the length of the pile directly responds to the extent of said backward displacement of sliding member 1.

On the other hand, as said backward displacement of sliding member 1 increases, and the bridle B gets longer, the effectiveness of rim portion 5 when cutting pile thread $F_p$ is affected, because bridle B is less stretched. However, in this case, it is sufficient to postpone the cutting step of bridle B. Said step, instead of occurring before rank R under formation is unloaded—as in the above described example—will occur later, namely when, after rank R and possibly one or more following ranks have been unloaded, as a consequence of the pulling action exerted on the fabric by the takedown system, bridle B is suitably stretched.

It will be appreciated that with such procedure sliding member 1, while keeping on retaining a still uncut bridle B, can create without difficulty other bridles in the following rank. In fact, when foot 4 moves again in order to separate and retain pile thread $F_p$, according to the above described process, it keeps on retaining the one or more bridles already formed in the previous ranks. Then, each bridle will be cut by rim portion 5 as soon as a suitable stretching is reached.

It will be apparent from the above that according to the invention the cut pile is formed in the course of the knitting productive step, i. e. when the corresponding base stitches are formed, thereby avoiding the productive costs involved by an additional shearing step. Besides, the way the cut is performed is such that pile thread $F_p$ is by no means wasted, and its length entirely turns into effective length of the pile.

In the example depicted in FIG. 5, stitches associated to pile formations are followed by a portion of fabric T formed by alternate rightside and backside stitches, knitted by needles $A_9$–$A_{12}$. On the contrary, in FIG. 3 pile-associated stitches are adjacent to a series of rightside stitches, i.e. those knitted by needles $A_1$–$A_4$. However, it has to be stressed that the arrangements of sliding members 1 shown in the figures have simply exemplifying purposes. Actually, the arrangement/combination of needles and sliding members can be freely set, considering that, with the process according to the invention, when cut pile is formed in correspondence to a stitch, the stitches formed by the adjacent needles are by no means affected.

In other words, a single pile formation on a backside stitch, or a plurality thereof in a row, can,be placed at will between normal rightside and backside stitches, single or in a row. Moreover, sliding members 1 can operate in a rank and kept in a non-working position in the previous or following one, as clearly explained by the example of FIG. 3, in which no pile is formed in ranks $R_I$ and $R_{II}$.

As a result of the above, it is possible to spread the pile on the backside stitches so as to form any fancy design one wishes, by suitably arranging the needles and the sliding members and controlling the operation thereof. Said designs can be set all over the height of the fabric, and be combined with jacquard or links-links patterns, obtainable on the rightside stitches by using known systems.

In an improved knitting machine according to the invention, sliding members 1 are operated via butts 3, as obvious to the skilled person, by an independent system which is perfectly analogous to that commonly used for operating the needles. As an alternative, the stitch transfer system, available on the machine, can be used.

Sliding members 1, besides replacing respective needles in the needlebed which is opposite to that forming the base of the corresponding stitches (as in the above described embodiment), can be associated to such needles, sliding side by side thereto, in the same grooves or in supplementary ones formed between the needles. In this case, obviously, when a needle operates, the adjacent sliding member shall be in a non-working condition. Conversely, when a sliding member 1 operates on the pile thread, the corresponding adjacent needle shall be in a backward displaced, non-working condition.

Such expedient allows a quick setting of the machine, as a function of the result one wishes to obtain, by simply selecting the sliding members which have to be operated. Even more advantageously, it is possible not to affect the needle-operating system. In fact, the operation of the sliding members can be carried out by the device of a known type—which is conventionally used for controlling the needles in order to obtain jacquard weaves. The device is provided with a mechanical or electronic programmable control system.

If the latter solution is chosen, changes have to be brought about to the guide track used for operating the sliding members, as obvious to a skilled person. Namely, the size of the forward movement section has to be appropriate, so as to achieve a correct operative positioning of foot 4 of sliding member 1, a suitable synchronization with the movement of the needle which, on the opposite needlebed, forms the corresponding stitch, as well as the desired backward displacement of member 1 when retaining bridle B. The forward movement of sliding member 1, for cutting bridle B with rim portion 5, can also be controlled by the cams which, in the conventional machine, carry out the stitch transfer.

In this way, the range of products which can be realized is even wider. In fact, all the functional features of a conventional knitting machines can be maintained, and namely the possibility of using the needles of both needlebeds for accomplishing the start of the piece of knitted fabric, the separation of the pieces, the transfer of single stitches from a needlebed to the other, in order to form tubular fringes etc., all this in combination with pile fancy designs, such as pile jacquard patterns in two or more colors, obtainable according to the invention.

Even though in the present description reference has been made to flat knitting machines, it is apparent that according to the invention, sliding members operating as described above can be used similarly also in double-bed circular knitting machines, with adjustments that are obvious to an expert in the field. For example, as far as the shape of sliding elements 1 is concerned, the angle between foot 4 and shank 2 (more precisely, between the respective axes), has to be adjusted. In fact, in a flat machine, having needlebeds mutually angled by 80° or less, said angle can be of 140° and over, while in a circular machine, having mutually normal needlebeds, it will not overcome 135°.

Cutting rim portion 5 can be parallel to the axis of shank 2, instead of being inclined towards foot 4, especially in the above described working mode (for forming longer pile) in which the bridles are mainly stretched by the fabric take-down system. Even the type of yarn used can affect the shape of sliding members 1, because when thick yarns are knitted, foot 4 need not be pointed in order to separate and retain pile thread $F_p$.

On the other hand, the process according to the invention can be carried out even by making use of devices which are different from the above described sliding members, provided that they are able to assure an equivalent working, that is, separating and retaining the pile thread for forming a bridle on the backside stitch when the corresponding needle is hooking the yarn, and cutting said bridle so that cut pile is formed.

Variations and/or modifications can be brought to the process for knitting a weft-knitted fabric so that cut pile is formed on the backside stitches, the knitting machine operating according to the process and the knitted fabric obtainable with such process and machine without departing from the scope of the invention as set forth in the attached claims.

What is claimed is:

1. A process for knitting a weft-knitted fabric (T) composed of a base thread ($F_F$) and a pile thread ($F_p$) mutually coupled, the fabric being composed of a succession of adjacent courses, said process being carried our in a machine having mutually opposite needlebeds and needles that are each axially slidable in a respective needlebed, each needle being provided with an end hook and a movable lever, said needles being operated in correspondence to a feeding of the yarn feed, said process comprising, for each stitch to be formed:

effecting a forward movement of a selected needle ($A_8$) of a first one of the needlebed from a position in which an old stitch of said yarn, belonging to a previously formed course ($R_I$), is engaged with the selected needle ($A_8$) to an upper run end position, and opening said lever of said selected needle ($A_8$) by said old stitch during said forward movement of said selected needle ($A_8$);

engaging said selected needle ($A_8$) with said yarn by means of said hook when said selected needle ($A_8$) is in said upper end run position;

effecting a backward movement of said selected needle ($A_8$) from said upper end run position toward a lower run end position while closing said lever of selected needle ($A_8$) in order to form a new stitch by inserting said yarn that is engaged with said selected needle ($A_8$) inside said old stitch and to discharge said old stitch from said selected needle ($A_8$); and while said selected needle ($A_8$) is engaging said yarn, separating said pile thread ($F_p$) from said-base thread ($F_F$), forming a loop of said pile thread and subsequently cutting said loop in order to create a cut pile, as the fabric under formation progressively moves transverse to said courses.

2. The process according to claim 1, wherein said steps of separating said pile thread ($F_p$) from said base thread ($F_F$), forming a loop of said pile thread and subsequently cutting said loop are performed with sliding means (1) operating on a second one of the needlebeds opposite to the first one of said needlebeds to which said selected needle ($A_8$) belongs.

3. The process according to claim 2, wherein said sliding means (1) comprise at least one sliding member (1) that comprises a shank (2), an end foot (4) extending upward from said shank so that a substantially L-shaped arrangement is achieved, and a cutting rim portion (5) formed in the upper edge **(2*a*) of said shank, near said foot (4), said sliding member (l) being movable in a first forward movement so as to engage said pile thread ($F_p$) with said foot when said selected needle ($A_8$) moves forward in order to hook said yarn, and then in a second forward movement to cut said loop by said cutting rim portion (5)**.

4. The process according to claim 3, wherein said step of forming a loop is carried out by moving said sliding member (1) backward, while retaining said pile thread ($F_p$), to lengthen said loop in order to give the cut pile a selected length that is a function of the extent of backward movement of said sliding member (1).

5. The process according to claim 3, wherein the second forward displacement of said sliding member (1) occurs after said discharge of said new stitch, whereby said loop is retained and stretched by said sliding member in order to assist cutting of said loop.

6. The process according to claim 3, wherein said steps of separating said pile thread and forming said loop are carried out by moving said sliding member (1) until the end of its foot (4) is substantially in correspondence to a theoretical intersection axis between the planes of the first and second ones of the needlebeds and is slightly higher than said end hook of said selected needle ($A_8$).

7. The process according to claim 3, wherein said foot (4) of said sliding member (1) is pointed in order to assist engagement with said pile thread ($F_p$).

8. The process according to claim 3, wherein said cutting rim portion (5) of said sliding member (1) is inclined towards said foot (4) of said sliding member (1), in order to assist cutting of said loop by said sliding member (1).

9. The process according to claim 3, wherein said foot (4) and said shank (2) of said sliding member (1) are angled relative to one another by at least by 135°.

10. A knitting machine comprising:

two mutually opposite knitting needlebeds for forming a weft-knitted fabric (T) from a yarn composed of a base thread ($F_F$) and a pile thread ($F_p$) mutually coupled; and sliding means, slidable on one of said needlebeds, said sliding means being operable to separate and retain said pile thread ($F_p$), so that a loop of said pile thread is formed, and to subsequently cut said loop in order to create a cut pile.

11. The machine according to claim 10, wherein said sliding means comprise at least one sliding member (1) having a shank (2), an end foot (4) extending upward from said shank so that a substantially L-shaped arrangement is achieved, said foot (4) being positioned for engagement with said pile thread ($F_p$), and a cutting rim portion (5) formed in the upper edge (2*a*) of said shank near said foot (4), for cutting said loop.

12. The machine according to claim 11, wherein said foot (4) of said sliding member (1) is pointed, in order to assist engagement with said pile thread ($F_p$).

13. The machine according to claim 11, wherein said cutting rim portion (5) is inclined towards said foot (4), in order to assist cutting of said loop by said sliding member (1).

14. The machine according to claim 11, wherein said foot (4) and said shank (2) of said sliding member (1) are angled relative to one another by at least by 135°.

15. The machine according to claim 10, wherein said sliding means (1) selectively replace at least one needle of one of the needlebeds, and said sliding means are arranged as a function of a pile arrangement to be created on said fabric.

16. The machine according to claim 10, wherein said sliding means (1) are associated to respective needles of one of the needlebeds, and said sliding means are operable as a function of a pile arrangement to be created on said fabric.

17. The machine according to claim 16, wherein said sliding means (1) are housed in the same grooves as corresponding needles, adjacently thereto.

18. The machine according to claim 16, wherein said sliding means (1) are housed in supplementary grooves formed between the needles.

19. The machine according to claim 16, wherein said sliding means (1) are operatively associated to a control device for obtaining jacquard patterns and/or to cams conventionally controlling the stitch transfer.

20. A weft-knitted fabric comprising a plurality of successive courses of stitches formed by means of a yarn composed of a base thread ($F_F$) and a pile thread ($F_p$) mutually coupled, characterized in that said fabric comprises stitches with respective cut pile formations formed by said pile thread, combined, within one of said courses or among a plurality of mutually adjacent courses, with normal right-side or backside stitches.

21. A knitted fabric according to claim 20, wherein said pile formations are not uniform in length.

22. A knitted fabric according to claim 20, comprising pile jacquard patterns in two or more colors.

* * * * *